US010781815B2

(12) United States Patent
Ma et al.

(10) Patent No.: US 10,781,815 B2
(45) Date of Patent: Sep. 22, 2020

(54) LARGE-FLOW PLUNGER PUMP

(71) Applicant: JINTUO PETROLEUM MACHINERY MANUFACTRING CO., LTD., Daqing, Heilongjiang Province (CN)

(72) Inventors: Yuanzhi Ma, Daqing (CN); Qinghe Gao, Daqing (CN)

(73) Assignee: JINTUO PETROLEUM MICHINERY MANUFACTURING CO., LTD., Daqing, Heilongjiang Province (CN)

( * ) Notice: Subject to any disclaimer, the term of this patent is extended or adjusted under 35 U.S.C. 154(b) by 300 days.

(21) Appl. No.: 15/802,774

(22) Filed: Nov. 3, 2017

(65) Prior Publication Data

US 2018/0135617 A1 May 17, 2018

(30) Foreign Application Priority Data

Nov. 15, 2016 (CN) ..... 2016 1 1004600

(51) Int. Cl.

| | |
|---|---|
| ***F04B 53/00*** | (2006.01) |
| ***F04B 53/18*** | (2006.01) |
| ***F04B 53/08*** | (2006.01) |
| ***F04B 19/22*** | (2006.01) |
| ***F04B 53/10*** | (2006.01) |
| ***F04B 53/14*** | (2006.01) |
| ***F04B 53/22*** | (2006.01) |

(52) U.S. Cl.

CPC ..... *F04B 53/18* (2013.01); *F04B 19/22* (2013.01); *F04B 53/003* (2013.01); *F04B 53/08* (2013.01); *F04B 53/10* (2013.01); *F04B 53/14* (2013.01); *F04B 53/22* (2013.01)

(58) Field of Classification Search

CPC ..... F04B 19/22; F04B 1/0421; F04B 1/0538; F04B 53/10; F04B 53/1087; F04B 53/14; F04B 53/16; F04B 53/162

See application file for complete search history.

(56) References Cited

U.S. PATENT DOCUMENTS

| | | | | |
|---|---|---|---|---|
| 10,352,321 | B2 * | 7/2019 | Byrne | F04B 1/0404 |
| 2011/0239856 | A1 * | 10/2011 | Tiller | F04B 53/18 92/153 |
| 2014/0322050 | A1 * | 10/2014 | Marette | F04B 47/02 417/437 |
| 2015/0132157 | A1 * | 5/2015 | Whaley | F04B 47/02 417/321 |
| 2017/0082103 | A1 * | 3/2017 | Morreale | F04B 53/1032 |

* cited by examiner

*Primary Examiner* — Dominick L Plakkoottam
(74) *Attorney, Agent, or Firm* — Birch, Stewart, Kolasch & Birch, LLP

(57) ABSTRACT

The present invention discloses a large-flow plunger pump, comprising a box, a crank-link mechanism, a plunger, a suction valve and a discharge valve. On the basis of the conventional multi-cylinder plunger pumps, assemblies such as a detachable upper crosshead guide, an intelligent plunger packing lubrication system, a damping valve, crankshaft support roller assemblies, and a suction-pressure stabilizer having a cooling water coil therein are invented. Both the service life and the reliability of the large-flow plunger pumps are overall improved.

7 Claims, 6 Drawing Sheets

LARGE-FLOW PLUNGER PUMP

This application claims priority to Chinese application number 2016110046000, filed Nov. 15, 2016, with a title of LARGE-FLOW PLUNGER PUMP. The above-mentioned patent application is incorporated herein by reference in its entirety.

TECHNICAL FIELD

The present invention relates to the technical field of power reciprocating pumps and in particular to a single-acting multi-cylinder large-flow plunger pump.

BACKGROUND

Large-area joint injection is a more economical and effective means in the water injection and oil production process for oilfields. The large-area joint injection requires large-flow (≥100 $m^3$/h) injection pumps. At present, multi-stage centrifugal injection pumps are used. However, such multi-stage centrifugal injection pumps have the disadvantages of low efficiency and high energy waste. It has been proven, both theoretically and practically, that large-flow plunger pumps are ideal products that can substitute the low-efficiency centrifugal injection pumps.

Nevertheless, most of the existing large-flow plunger pumps have the following deficiencies: high noise, which is mainly the impact noise of the valve; short service life of the plunger packing, which is mainly resulted from the quick wearing of the plunger packing; difficult to replace quick-wear parts at the power end, which means that it is necessary to dismount the crank to replace the crosshead pins, the pin bushings, support bearings (bearing bushes) or the like and in order to dismount the crank, it is necessary to move the reducer and the high-voltage motor, which operation is quite difficult; and high difficulty in supporting the crank at the power end, which is mainly resulted from the too high precision required for processing and mounting the positioning holes for the support bearings (bearing bushes). Furthermore, the lubrication oil cooling water at the power end of the plunger pump (including the cooling of the lubrication oil for the reducer and the cooling of the high-voltage water-cooled motor) is naturally circulated and cooled by a cooling tower. By naturally cooling by a cooling tower, the temperature of the circulating cooling water is highly influenced by the change in the ambient temperature so that the cooling effect is instable. Moreover, the waste heat discharged to the atmosphere will produce the heat island effect, thereby resulting in energy waste and secondary pollution.

The Utility Model Patent ZL200820021336.6 disclosed a large-displacement horizontally-opposed high-pressure plunger pump. In such an opposed plunger pump, the number of parts is almost doubled and the number of quick-wear parts is also doubled. The running reliability of the pump is significantly influenced. The volume of the pump is also increased greatly, with high mounting and construction cost and high maintenance cost. A suction pipeline and a discharge pipeline are provided at two ends of the pump, respectively. The arrangement and maintenance of pipelines are influenced.

The Invention Patent 201210194304.7 disclosed a large-flow reciprocating injection pump for oilfields. The known mature technologies are simply combined together from the aspects of the structure of the reciprocating pump and the combined ball valve. The combined ball valve (ZL2013201787566) used in this patent will produce high impact noise when used in the large-flow plunger pump.

In order to prolong the service life of the plunger packing seal, in Patent ZL200620087005, entitled "PLUNGER LUBRICATION DEVICE", liquid oil is sprayed to an exposed portion around the plunger by evenly-distributed oil spray nozzles to form an oil film on the plunger. In this way, the plunger is lubricated, and the friction coefficient between the plunger and the packing is reduced. Thus the wear between the plunger and the packing is reduced, and the sealing performance is improved. However, in practice, the lubrication oil that can enter the friction pair between the packing and the plunger is limited because it is injected dropwise under normal pressure. Most of the lubrication oil is wasted. The loss outweighs the gain.

In order to ensure the running reliability of the crankshaft of the large-flow plunger pump, in Patent ZL2013205744818, entitled "HIGH-POWER FIVE-PLUNGER HIGH-PRESSURE RECIPROCATING PUMP", a correcting bush is mounted on the crank of the crankshaft to prevent the deformation of the crankshaft. The mounting of the correcting bush also requires high precision for processing, mounting and maintaining.

Improving and innovating the existing structure to ensure the continuous and reliable running of the large-flow plunger pump in order to overall prolong the service life and to realize the high-efficiency and energy-saving purposes has become a problem to be solved.

SUMMARY

An objective of the present invention is to provide a large-flow plunger pump in which, by providing assemblies such as a detachable upper crosshead guide, an intelligent plunger packing lubrication system and crankshaft support roller assemblies, it is convenient for the maintenance of quick-wear parts, the friction coefficient of the plunger packing is decreased, the multi-cylinder multi-support of the crankshaft is fulfilled, the reliability of the crankshaft is significantly improved, and the service life of large-flow plunger pumps is prolonged overall. Thus, such a large-flow plunger pump is efficient and energy-saving.

For this purpose, the present invention employs the following technical solutions.

The present invention provides a large-flow plunger pump, comprising a box, a crank-link mechanism, a crosshead, a plurality of plungers, a suction valve and a discharge valve; the crank-link mechanism drives the plurality of plungers to do reciprocating motion; a crosshead guide hole comprises a detachable upper crosshead guide and a lower crosshead guide located on an inner surface of the box, the detachable upper crosshead guide being connected to the lower crosshead guide via positioning pins and fixing bolts; on each of the plurality of plungers, a plunger packing lubrication system is provided, which supplies lubrication oil to each of the plurality of plungers by a multi-point lubrication oil pump via a check valve and a pressure sensor, a high-pressure lubrication oil pump of the multi-point lubrication oil pump supplies lubrication oil to a plurality of plunger packing sets separately via a plurality of lubrication oil pipes; and, both the suction valve and the discharge valve are damping valves, each of the damping valves comprises a damping ring which is provided between a valve plate integrally vulcanized with the damping ring and a valve seat, and a volume cavity which is communicated with a valve chamber via pores on the valve plate is formed within the damping ring.

Preferably, the large-flow plunger pump further comprises crankshaft support roller assemblies mounted on a periphery of a crank of a crankshaft of the crank-link mechanism; each of the crankshaft support roller assemblies comprises a roller and a fixed mount; a gap between each of the plurality of rollers and the crank is adjustable; and each of the plurality of rollers is arranged on the fixed mount and the fixed mount is fixed on the box.

Preferably, on the top of the detachable upper crosshead guide, an upper cover plate is provided; and a pull rod assembly is provided between the detachable upper crosshead guide and the upper cover plate.

Preferably, the damping ring has a reinforcing plate on its bottom.

Preferably, the gap between the rollers and the crank can be adjusted by adjusting screws or other devices (for example, hydraulic devices).

Preferably, the large-flow plunger pump further comprises a suction-pressure stabilizer which is, having a cooling water coil therein, provided at a suction inlet of the plunger pump.

Preferably, a circulating cooling water inlet at one end of the cooling water coil is communicated with a water replenishing device via a pipeline while the other end of the cooling water coil is communicated with a cooling water inlet of a plunger pump oil pool cooling coil, the cooling water becomes high-temperature water after absorbing heat from the lubrication oil when flowing through the oil pool cooling coil, a high-temperature water outlet is communicated with a domestic heat supply pipeline, and the domestic heat supply pipeline is communicated with the water replenishing device (it can be a water replenishing tank).

Compared with the prior art, the present invention has the following technical effects.

In the present invention, on the basis of the conventional multi-cylinder plunger pumps, assemblies such as a detachable upper crosshead guide, an intelligent plunger packing lubrication system, a damping valve, crankshaft support roller assemblies, a pull rod assembly, and a suction-pressure stabilizer having a cooling water coil therein are invented. The service life of the large-flow plunger pumps is overall improved.

The upper crosshead guide can be detached from the upper part of the chassis, which is convenient to maintain and replace the crosshead, the crosshead pins, the crosshead pin bushings, the links and other parts. The intelligent plunger packing lubrication system can discontinuously inject high-pressure lubrication oil to the friction pair between the plunger and the packing within a certain pressure range, in order to reduce the friction coefficient of the plunger packing and prolong the service life of the plunger packing. During the placement of the valve plate into the valve seat, due to the arrangement of the damping valve, the impact on the valve seat from the valve plate is effectively decreased, the noise produced by the pump is reduced, and the service life of the valve is prolonged. By providing a plurality of roller assemblies on the periphery of the crank of the crankshaft, the multi-cylinder multi-support of the crankshaft is fulfilled, and the reliability of the crankshaft is significantly improved. By the arrangement of the cooling water coil within the suction-pressure stabilizer, the circulating cooling water is cooled by the pumping medium. This is simple, energy-saving, and reliable. The continuous, reliable, high-efficient and energy-saving running of the large-flow plunger pump is ensured.

BRIEF DESCRIPTION OF THE DRAWING

To describe the technical solutions in the embodiments of the present invention or in the prior art more clearly, the accompanying drawings to be used in the description of the embodiments will be briefly described below. Apparently, the drawings described hereinafter are some of the embodiments of the present invention, and a person of ordinary skill in the art can obtain other drawings according to these drawings without any creative effort.

FIG. 7 is a schematic view of a suction-pressure stabilizer of a cooling water coil arranged within the large-flow plunger pump according to an embodiment of the present invention, in which:

Figure 1:
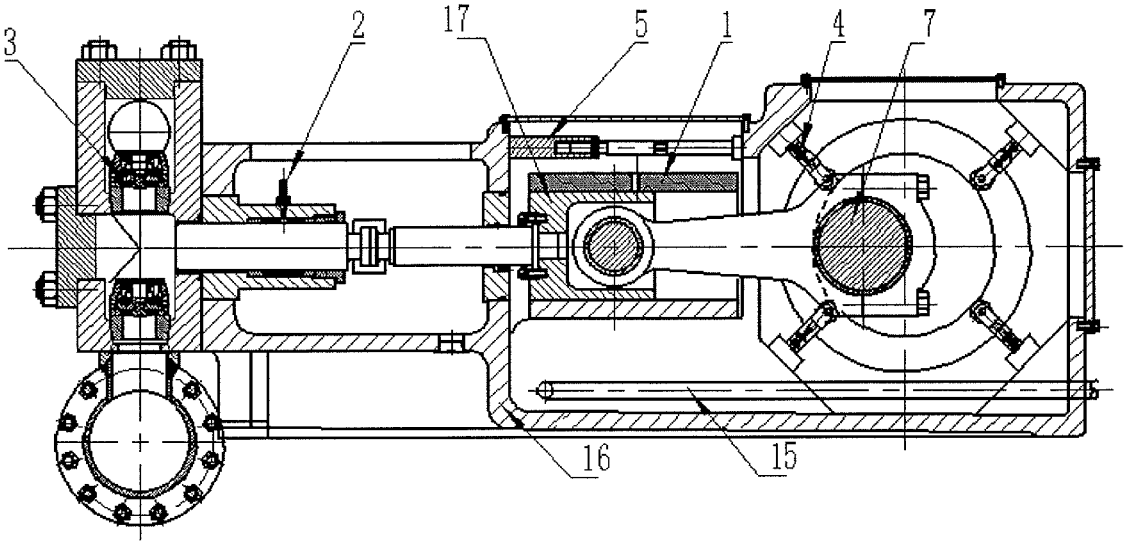
FIG. 1 is a schematic view of a large-flow plunger pump according to an embodiment of the present invention.

1: upper detachable crosshead guide;
1-1: positioning pin;
1-2: fixing bolts;
1-3: lower crosshead guide;
2: plunger packing lubrication system;
2-1: front guide sleeve;
2-2: front packing;
2-3: oil ring;
2-4: rear packing;
2-5: rear guide sleeve;
2-6: gland nut;
2-7: plunger;
2-8: packing box;
2-9: multi-point lubrication oil pump;
2-10: check valve;
2-11: pressure sensor;
3: damping valve;
3-1: valve plate;
3-2: valve seat;
3-3: damping ring;
Q: volume cavity;
K: pore;
T: reinforcing plate;
4: crankshaft support roller assembly;
4-1: roller;
4-2: adjusting screw;
4-3: fixed mount;
5: pull rod assembly;
6: suction-pressure stabilizer;
6-1: cooling water coil;
7: crank-link mechanism;
7-1: crank;
8: cooling water inlet;
9: high-temperature water outlet;
10: domestic heat supply pipeline;
11: water replenishing tank;
12: plunger pump suction inlet;

13: circulating cooling water inlet;
14: upper cover plate;
15: plunger pump oil pool cooling coil;
16: box; and
17: crosshead.

DETAILED DESCRIPTION

The technical solutions in the embodiments of the present invention will be clearly and completely described below with reference to the accompanying drawings in the embodiments of the present invention. Apparently, the embodiments described herein are merely a part but not all of the embodiments of the present invention. All other embodiments obtained by a person of ordinary skill in the art without any creative effort on the basis of the embodiments in the present invention shall fall into the protection scope of the present invention.

An objective of the present invention is to provide a large-flow plunger pump to solve the problems in the prior art and to improve the performance and the service life of large-flow plunger pumps.

To make the objectives, features and advantages of the present invention more obvious and comprehensible, the present invention will be further described below in detail by specific implementations with reference to the accompanying drawings.

Embodiment 1

As shown in FIGS. 1, 2, 3 and 5, the structure and principle of a large-flow plunger pump of the present invention will be described in this embodiment.

This embodiment provides a large-flow plunger pump, comprising a box 16, a crank-link mechanism 7, a crosshead 17, a plurality of plungers 2-7, a suction valve and a discharge valve. The crank-link mechanism 7 drives the plurality of plungers 2-7 to do reciprocating motion. A crosshead 17 guide hole comprises a detachable upper crosshead guide 1 and a lower crosshead guide 1-3 located on an inner surface of the box. The detachable upper crosshead guide 1 is connected to the lower crosshead guide 1-3 via positioning pins 1-1 and fixing bolts 1-2. On each of the plurality of plungers 2-7, a plunger packing lubrication system 2 is provided, which supplies lubrication oil to each of the plurality of plungers by a multi-point lubrication oil pump via a check valve 2-10 and a pressure sensor 2-11, and a high-pressure lubrication oil pump of the multi-point lubrication oil pump supplies lubrication oil to a plurality of plunger packing sets separately via a plurality of lubrication oil pipes. Both the suction valve and the discharge valve are damping valves 3, each of the damping valves 3 comprises a damping ring 3-3 which is provided between a valve plate 3-1 integrally vulcanized with the damping ring 3-3 and a valve seat 3-2, and a volume cavity Q which is connected to a valve chamber via pores K on the valve plate 3-1 is formed within the damping ring 3-3. The damping ring 3-3 has a reinforcing plate T on its bottom. On the top of the detachable upper crosshead guide 1, an upper cover plate 14 is provided; and a pull rod assembly 5 is provided between the detachable upper crosshead guide 1 and the upper cover plate 14.

Figure 3:
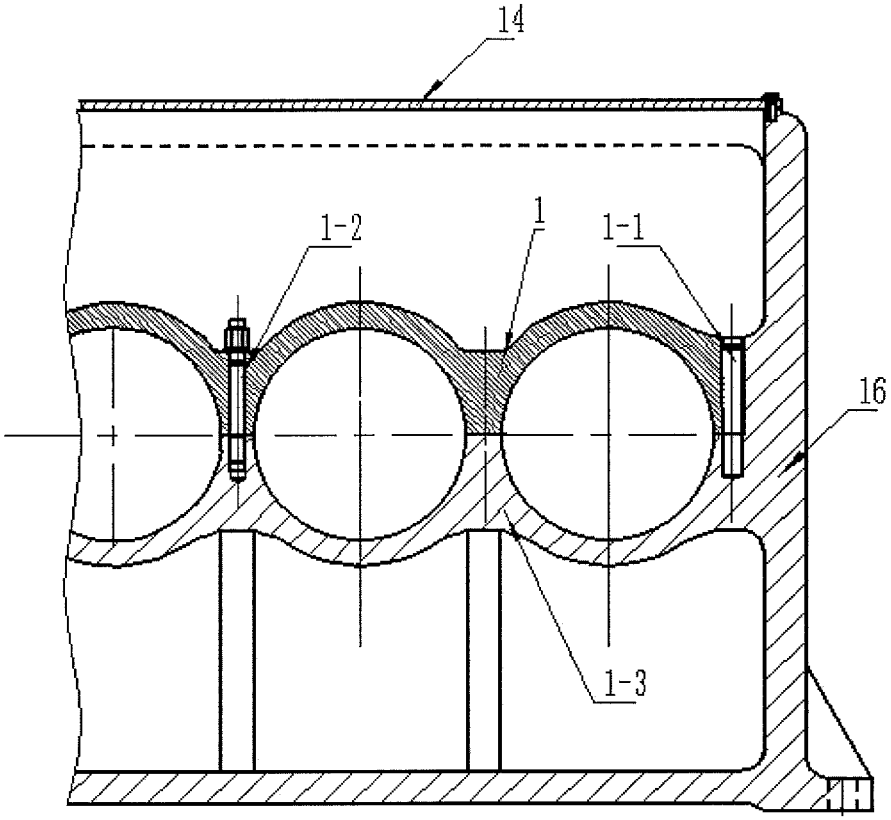
FIG. 3 is a schematic view of an upper detachable crosshead guide in the large-flow plunger pump according to an embodiment of the present invention.

As shown in FIG. 1 and FIG. 3, as a large-flow plunger pump, a multi-cylinder (for example, five cylinders, seven cylinders, nine cylinders, etc.,) plunger pump is usually used. The detachable upper crosshead guide 1 forms, together with the lower guide located on the box 16, an integral guide hole via the positioning pins 1-1 and the fixing bolts 1-2. The interface between the upper guide and the lower guide is at a horizontal centerline of a cross-sectional circle. When it is necessary to maintain or replace parts such as crosshead pins, crosshead pin bushings, crossheads 17 and links, the upper cover plate 14 is opened, the pull rod assembly 5 is removed, the positioning pins 1-1 are pulled out, and the fixed bolts 1-2 are released. In this way, the detachable upper crosshead guide 1 can be taken out from the space on the top of the box 16. Thus, it is convenient for maintenance and replacement. Parts such as the crankshaft 7 are not needed to be first detached as the case in the conventional large-flow plunger pumps. It is therefore both effort and workload saving, safe and reliable.

Since the detachable upper crosshead guide 1 is separated from the box 16, the guide has a substantially hollow upper half part, without sufficient support, and thus may be deformed during the operation of the large-flow plunger pump. As shown in FIG. 1, proving the pull rod assembly 5 in the upper part of a chassis (on the left side of the detachable upper crosshead guide 1) increases the compressive strength of the upper half part of the guide.

Figure 5:
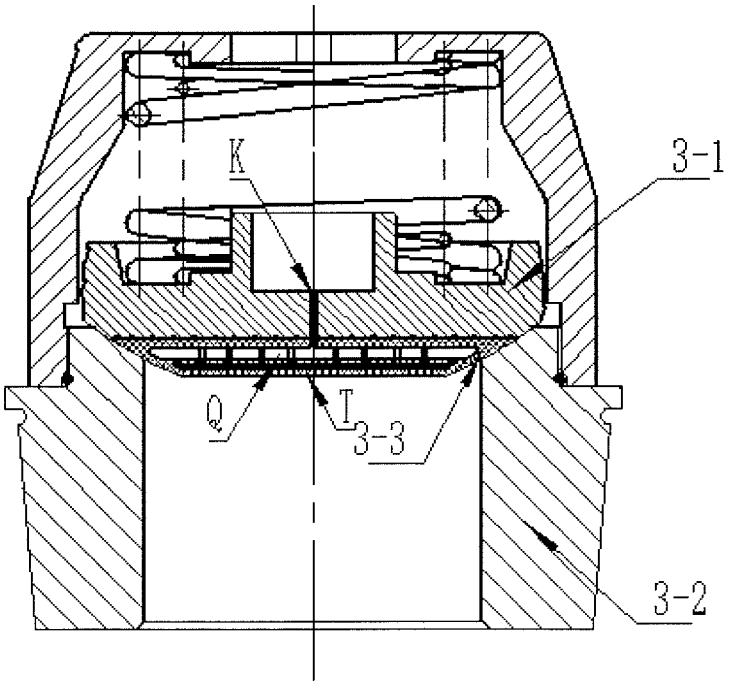
FIG. 5 is a schematic view of a damping valve in the large-flow plunger pump according to an embodiment of the present invention.

Due to the large flow of large-flow plunger pumps, valves are designed in large size. Accordingly, a large contact area between the valve plates and the valve seats is caused, and the large contact area results in great impact on the valve seats from the valve plates. As a result, high noise is produced, which pollutes the environment and does harm to the physical and psychological health of operators. In the damping valve as shown in FIG. 5, the damping ring 3-3 is integrally vulcanized with the valve plate 3-1, and a volume cavity Q which is communicated with a valve chamber via pores K is formed within the damping ring. During the placement of the valve into the valve seat, the damping ring 3-3 comes into contact with the valve seat 3-2 first. The damping ring and the valve plate are made of rubber (for example, polyurethane) and thus somewhat elastic. The valve plate is integrally formed with the damping ring. The damping ring plays a role of caching and sealing, and absorbs most of impact so that the noise of the valve is reduced. Meanwhile, the volume cavity Q within the damping ring is filled with high-pressure medium via the pores K, so that the damping ring 3-3 made of rubber is supported and the fatigue deformation of the damping ring 3-3 made of rubber is slowed down. For both the suction valve and the discharge valve, during the placement of such a valve into the respective valve seat, the pores K are always communicated with the high-pressure medium. After the high-pressure medium is filled into the volume cavity within the damping ring 3-3, a portion of a contact surface between the damping ring 3-3 and the valve seat 3-2 deforms and swells toward a sealing surface of the valve seat 3-2, since a reinforcing plate T is provided on the bottom of the damping ring 3-3. This ensures that the damping ring 3-3 first comes into contact with the valve seat 3-2 for the purpose of damping, and then the valve plate 3-1 comes into contact with the valve seat 3-2 to realize reliable sealing with the valve seat 3-2. At the momentary contact between the valve plate 3-1 and the valve seat 3-2, the excessive part of medium inside the volume cavity Q within the damping ring 3-3 is expelled due to a large stress applied to the upper part of the valve plate 3-1. A portion of the damping ring 3-3 that may influence the contact with the valve seat 3-2 is retracted. In this way, the tight contact between the valve plate 3-1 and the valve seat 3-2 is ensured. The shape of the contact surface between the damping ring 3-3 and the valve seat 3-2 is the same as that of the contact surface between the valve plate 3-1 and the valve seat 3-2.

Embodiment 2

Figure 4:
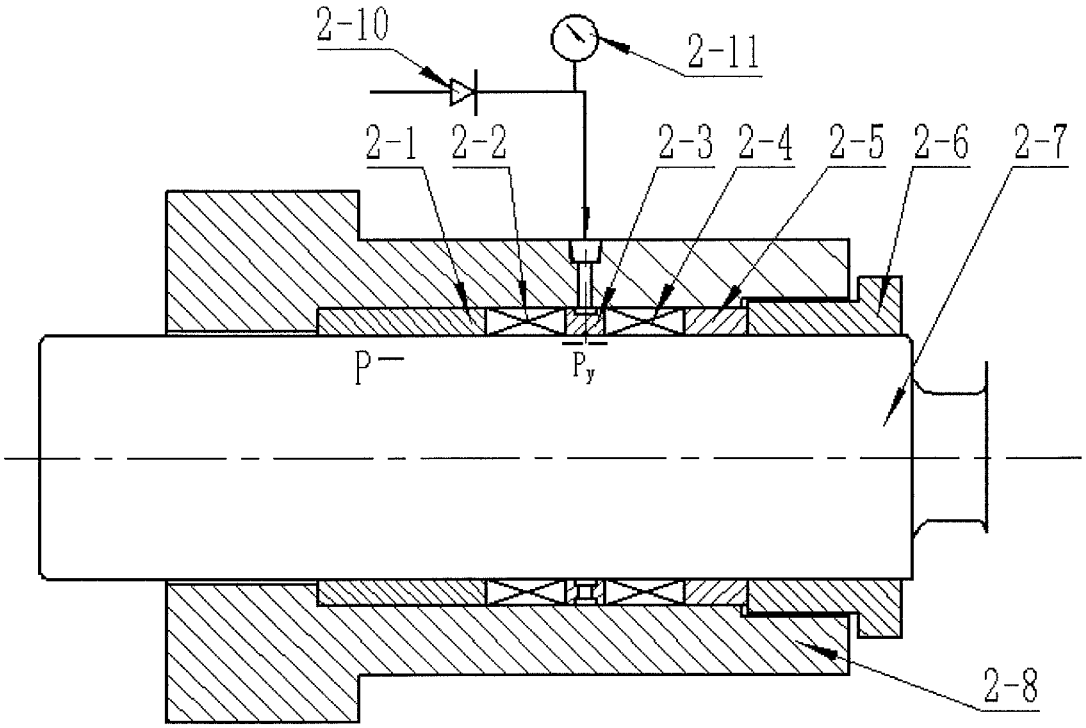
FIG. 4 is a schematic view of a plunger packing lubrication structure in the large-flow plunger pump according to an embodiment of the present invention.
Figure 6:
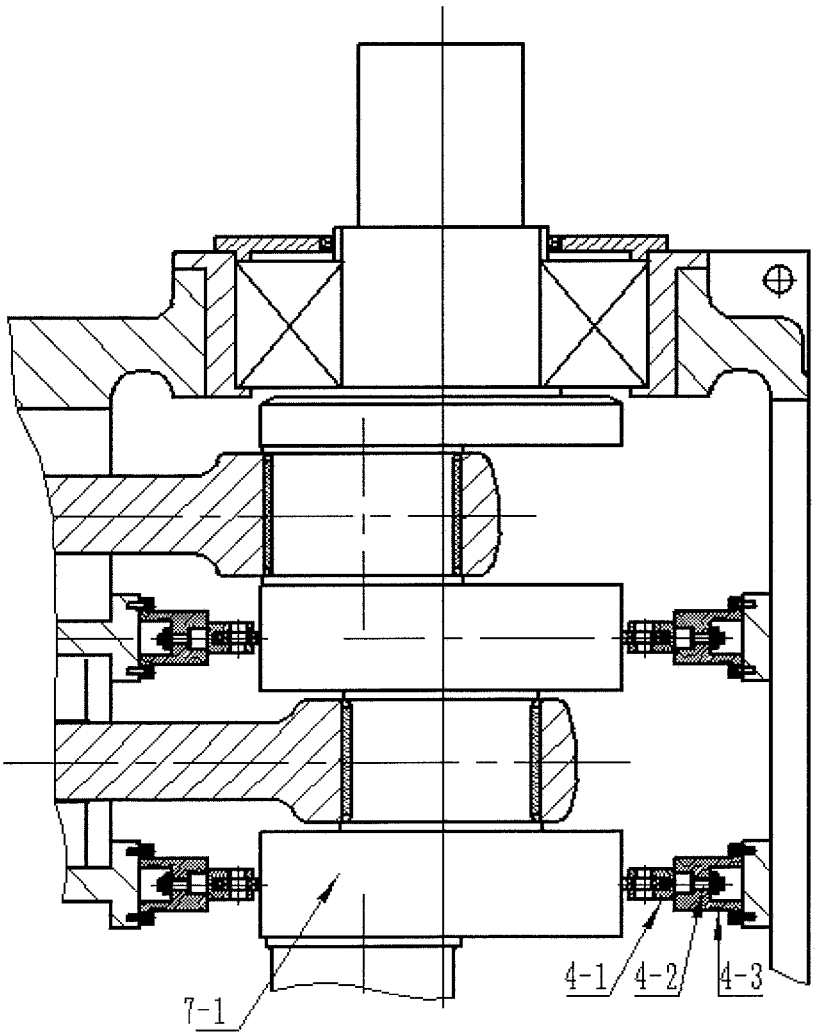
FIG. 6 is a schematic view of crankshaft support roller assemblies in the large-flow plunger pump according to an embodiment of the present invention.
Figure 7:
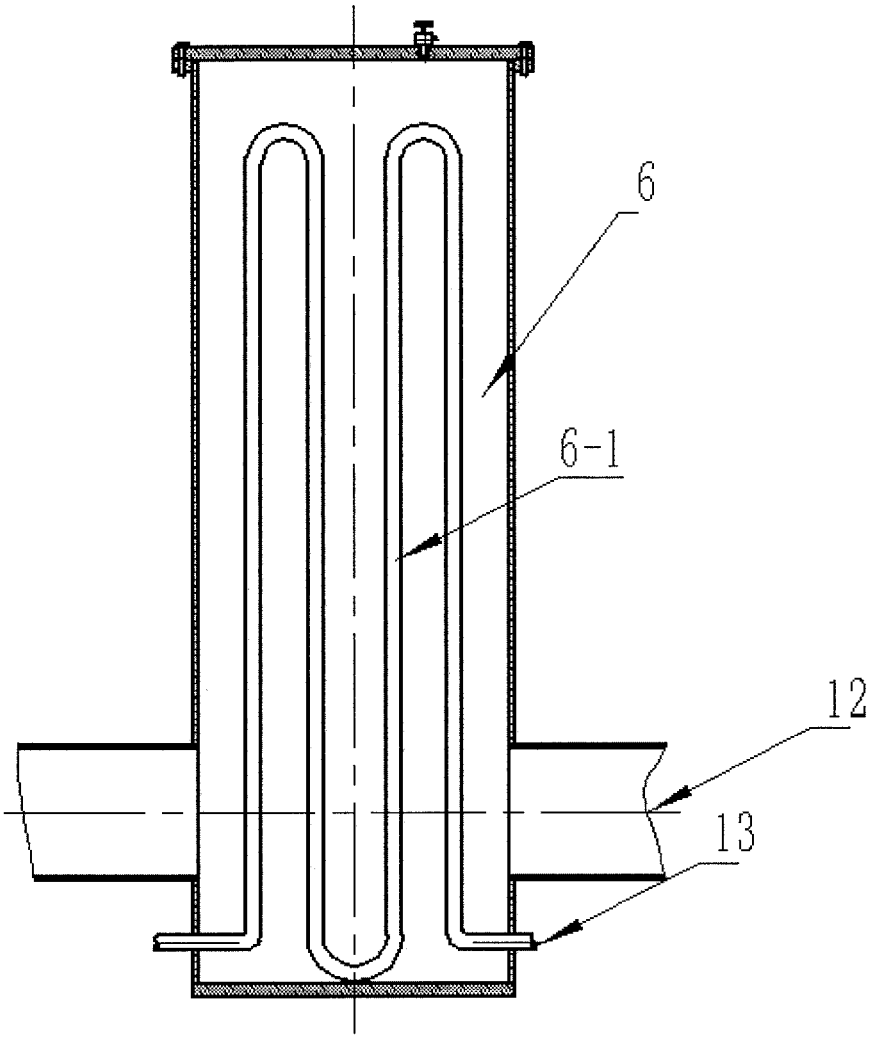

As shown in FIGS. 4, 6 and 7, this embodiment is an improved embodiment on the basis of Embodiment 1. In this embodiment, the present invention will be further described in detail.

As shown in FIG. 4, this embodiment provides a large-flow plunger pump. The plunger 2-7 packing sets comprise a packing box 2-8, a front packing 2-2, a rear packing 2-4 and an oil ring 2-3. The packing box 2-8 is socketed outside the plunger 2-7. A front guide sleeve 2-1, the front packing 2-2, the oil ring 2-3, the rear packing 2-4 and a rear guide sleeve 2-5 are arranged successively between the packing box 2-8 and the plunger 2-7. Finally, a gland nut 2-6 is socketed between the plunger 2-7 and the packing box 2-8 and resisted against the rear guide sleeve 2-5. An oil pipe is communicated with the oil ring 2-3 via the pores K on the packing box 2-8.

During the operation, the oil supply pressure of the high-pressure lubrication oil pump in the multi-point lubrication oil pump 2-9 is set, i.e., $Py=(1/3\sim2/3)P$, where P is the discharge pressure of the plunger pump. When a pressure sensor 2-11 indicates $Py<1/3P$, the high-pressure lubrication oil pump starts supplying lubrication oil; and when the pressure sensor 2-11 indicates $Py>2/3P$, the high-pressure lubrication oil pump stops supplying lubrication oil. In this way, dynamic oil pressure balance is maintained within the plunger packing sets.

In this case, when the plunger pump is in the discharge stroke, the pressure at the front packing 2-2 is calculated by $P-Py=P-(1/3\sim2/3)P=(2/3\sim1/3)P$; and the pressure at the rear packing 2-4 is calculated by $Py-Pq=(1/3\sim2/3)P-0=(1/3\sim2/3)P$, where Pq denotes the atmospheric pressure which is relatively low when compared with the discharge pressure and usually considered as 0.

When the plunger pump is in the suction stroke, the pressure at the front packing 2-2 is calculated by $Py-Px=(1/3\sim2/3)P-0=(1/3\sim2/3)P$, where Px denotes the suction pressure which is relatively low when compared with the discharge pressure and usually considered as 0; and the pressure at the rear packing 2-4 is calculated by $Py-Pq=(1/3\sim2/3)P-0=(1/3\sim2/3)P$, where Pq denotes the atmospheric pressure which is relatively low when compared with the discharge pressure and usually considered as 0.

If only the front packing 2-2 fails, the pressure value displayed by the pressure sensor 2-11 on the plunger packing lubrication pipeline is equal to, or approaches, the discharge pressure of the plunger 2-7 pump. The intelligent control system then gives an alarm to alert the operator of the failure of the front packing 2-2 and thus the replacement of a new front packing.

If only the rear packing 2-4 fails, the pressure value displayed by the pressure sensor 2-11 on the plunger packing lubrication pipeline is equal to, or approaches, 0. The intelligent control system then gives an alarm to alert the operator of the failure of the rear packing 2-4 and thus the replacement of a new rear packing. Of course, the rear packing 2-4 will serve for a much longer period of time than the front packing 2-2.

If both the front packing and the rear packing 2-4 fail, the flow of the large-flow plunger pump will be insufficient and the flow monitoring system will gives an alarm.

During the operation of the plunger 2-7 pump, the pressure at both the front packing 2-2 and the rear packing 2-4 is $(1/3\sim2/3)P$. The uniform pressure distribution avoids the influence on the fatigue life of the packings from the high alternating stress. Meanwhile, it is easier for the lubrication oil to permeate into the friction pair between the plunger packings under high pressure. Accordingly, the friction coefficient therebetween is reduced and the service life of the packings is prolonged. Most importantly, if the packings narrow, after the plunger packings are worn, in the axial direction (the movement direction of the plunger 2-7) under the effect of the high-pressure oil to ensure the tight contact with the plunger 2-7, the small gap resulted from the deformation is filled by the high-pressure oil (liquid is uncompressible under a certain pressure while the high-pressure oil is equivalently rigid. The amount of lubrication oil consumed by the friction pair between the plunger packings is limited and the lubrication oil can be replenished in time when decreasing down to a certain pressure). That is, the packings can be compensated automatically after being worn, without requiring any manual packing adjustment. This solves the practical difficulty that it is unable to tighten the gland nut manually and it is likely to cause the fluctuation of the high-voltage grid if the pump is stopped for adjustment, due to the large diameter (>100 mm) of the plunger 2-7 in the large-flow plunger pump and the large annular area stress (>55000N) at the packings.

As shown in FIG. 7, a suction-pressure stabilizer 6 having a cooling water coil 6-1 therein is provided at a suction inlet 12 of the plunger pump. The cooling water coil 6-1 is distributed within the suction-pressure stabilizer 6. A circulating cooling water inlet 13 at one end of the cooling water coil 6-1 is communicated with a water replenishing tank 11 via a pipeline while the other end of the cooling water coil 6-1 is communicated with a cooling water inlet 8 of a plunger pump oil pool cooling coil 15. The cooling water becomes high-temperature water after absorbing heat from the lubrication oil when flowing through the cooling coil within the oil pool. A high-temperature water outlet 9 is communicated with a domestic heat supply pipeline 10, and the domestic heat supply pipeline 10 is communicated with the water replenishing tank 11. What is cooled between the cooling water inlet 8 and the high-temperature water outlet 9 is the lubrication oil at the power end of the plunger pump.

Figure 2:
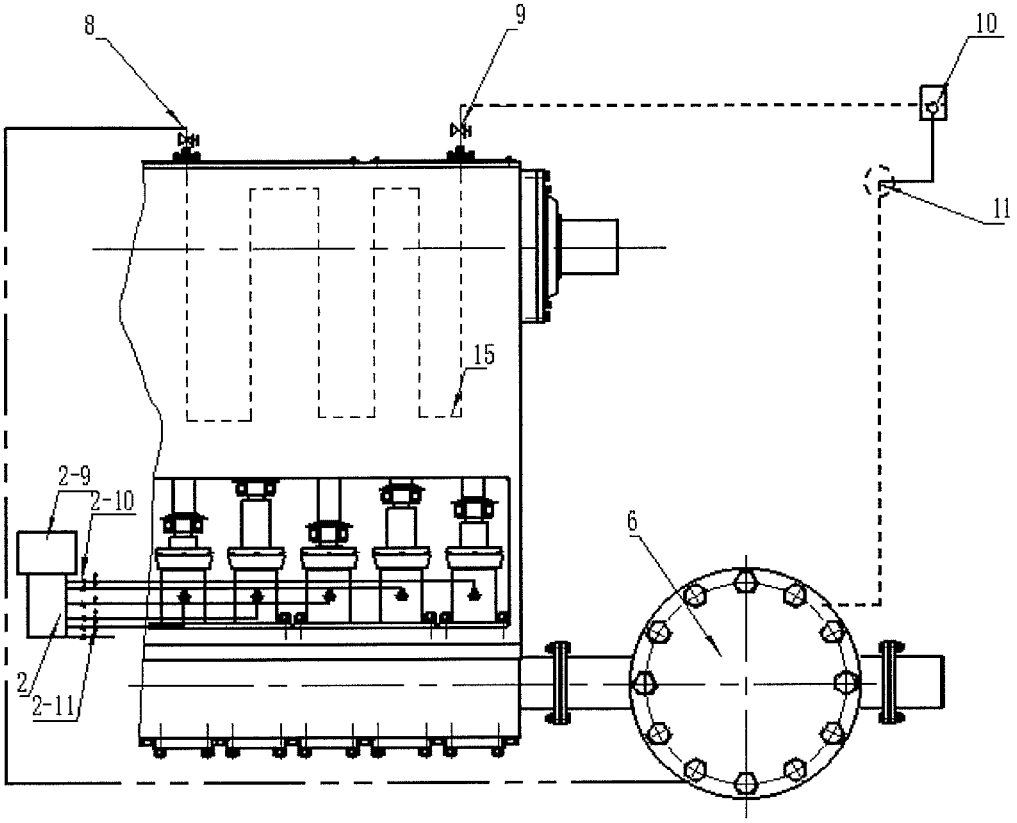
FIG. 2 is a schematic view of the arrangement of a lubrication oil cooling water circulation system and an intelligent plunger packing lubrication system in the large-flow plunger pump according to an embodiment of the present invention.

At the power end of the plunger pump, forced lubrication is usually applied. The lubrication oil is usually cooled by circulating water and the circulating water is cooled naturally by a cooling tower. For better utilization of the heat source, FIG. 2 indicates that the high-temperature water can be guided into and circulated within the domestic heat supply pipeline. Of course, the cooling water for the high-pressure water-cooled motor and the cooling water for the lubrication oil for the reducer in the pump assembly of the large-flow plunger pump can also be guided into this circulating system. The key point of this system, as shown in FIG. 2, is that the circulating water cooling realizes the cooling by pumping medium (for example, oilfield wastewater). As shown in FIG. 7, the circulating cooling water coil 6-1 is arranged within the suction-pressure stabilizer 6. When the circulating cooling water flows through the coil, the flowing medium takes heat away from the circulating cooling water. In this way, the circulating cooling water is cooled, so that the requirement of cooling the lubrication oil or the like is fulfilled. This structure is simple and compact, without resulting in the greenhouse effect.

As shown in FIG. 6, crankshaft support roller assemblies 4 are mounted on a periphery of a crank 7-1 of the crank-link mechanism 7. Each of the crankshaft support roller assemblies 4 comprises a roller 4-1 and a fixed mount 4-3; a gap between each of the plurality of rollers 4-1 and the crank 7-1 is adjustable; and each of the plurality of rollers 4-1 is arranged on the fixed mount 4-3 and the fixed mount 4-3 is fixed on the box 16.

Due to the large diameter of the plunger 2-7 in the large-flow plunger pump, the stress at the plunger 2-7 is usually above 160000N, and the stress at the power end is also high. Accordingly, the strength of the crankshaft is highly required. It is not ideal to solely increase the size or use high-strength material. Usually, a support bearing or a bearing bush is additionally provided on the crank 7-1 of the crankshaft. However, the precision for processing, mounting and maintaining the support bearing or the bearing bush is highly required. Furthermore, the support bearing or the bearing bush cannot be repaired if they are worn, and they are costly to use. As shown in FIG. 1, crankshaft support roller assemblies 4 are mounted on a periphery of a crank 7-1. FIG. 6 shows one structure of the crankshaft support roller assemblies 4. The crankshaft support roller assemblies 4, the number of which is not less than 3, are arranged on the periphery of each crank 7-1. The roller assemblies are mounted on the box 1 via a fixed mount 4-3. The roller 4-1 comes into contact with the crank 7-1. Adjusting screws 4-2 can be used to adjust the contact gap between the roller 4-1 and the crank 7-1. By supporting the crank 7-1 by the roller 4-1, the requirement for processing the chassis is low. The gap therebetween can be adjusted after they are worn. And, it is very simple to replace new ones if they are damaged.

Although the principle and implementations of the present invention have been described above by specific examples in the present invention, the foregoing description of the embodiments is merely for helping understand the method and core idea of the present invention. Meanwhile, various alterations to the specific implementations and applications may come to a person of ordinary skill in the art according to the concept of the present invention. In conclusion, the contents of the description shall not be regarded as limitations to the present invention.

What is claimed is:

1. A large-flow plunger pump, comprising a box, a crank-link mechanism, a crosshead, a plurality of plungers, a suction valve and a discharge valve; the crank-link mechanism drives the plurality of plungers to do reciprocating motion; a crosshead guide hole comprises a detachable upper crosshead guide and a lower crosshead guide located on an inner surface of the box, the detachable upper crosshead guide being connected to the lower crosshead guide via positioning pins and fixing bolts; on each of the plurality of plungers, a plunger packing lubrication system is provided, which supplies lubrication oil to each of the plurality of plungers by a multi-point lubrication oil pump via a check valve and a pressure sensor, a high-pressure lubrication oil pump of the multi-point lubrication oil pump supplies lubrication oil to a plurality of plunger packing sets separately via a plurality of lubrication oil pipes; and, both the suction valve and the discharge valve are damping valves, each of the damping valves comprises a damping ring which is provided between a valve plate integrally vulcanized with the damping ring and a valve seat, and a volume cavity which is communicated with medium via pores on the valve plate is formed within the damping ring.

2. The large-flow plunger pump according to claim 1, further comprising crankshaft support roller assemblies mounted on a periphery of a crank of a crankshaft of the crank-link mechanism; each of the crankshaft support roller assemblies comprises a roller and a fixed mount; a gap between each of the plurality of rollers and the crank is adjustable; and each of the plurality of rollers is arranged on the fixed mount and the fixed mount is fixed on the box.

3. The large-flow plunger pump according to claim 1, wherein, on the top of the detachable upper crosshead guide, an upper cover plate is provided; and a pull rod assembly is provided between the detachable upper crosshead guide and the upper cover plate.

4. The large-flow plunger pump according to claim 1, wherein the damping ring has a reinforcing plate on its bottom.

5. The large-flow plunger pump according to claim 2, wherein the gap between the rollers and the crank is adjusted by adjusting screws.

6. The large-flow plunger pump according to claim 1, further comprising a suction-pressure stabilizer which is, having a cooling water coil therein, provided at a suction inlet of the plunger pump.

7. The large-flow plunger pump according to claim 6, wherein a circulating cooling water inlet at one end of the cooling water coil is communicated with a water replenishing device via a pipeline while the other end of the cooling water coil is communicated with a cooling water inlet of a plunger pump oil pool cooling coil, a high-temperature water outlet is communicated with a domestic heat supply pipeline, and the domestic heat supply pipeline is communicated with the water replenishing device.

* * * * *